United States Patent [19]

Hogle

[11] 4,202,105

[45] May 13, 1980

[54] BRUSH GUIDE

[76] Inventor: Kenneth A. Hogle, 15 Golden Ct., Cromwell, Conn. 06416

[21] Appl. No.: 972,999

[22] Filed: Dec. 26, 1978

[51] Int. Cl.[2] ..... B43L 7/00; A46B 17/00

[52] U.S. Cl. ..... 33/483; 15/257 R

[58] Field of Search ..... 15/257 R, 248; 33/107 R; 401/48, 193; 118/207, 208

[56] References Cited

U.S. PATENT DOCUMENTS 1,441,715 1/1923 Rudersdorf ..... 33/107 R

FOREIGN PATENT DOCUMENTS 86209 of 1920 Fed. Rep. of Germany ..... 33/107 R

*Primary Examiner*—Robert W. Jenkins
*Assistant Examiner*—Timothy F. Simone
*Attorney, Agent, or Firm*—Fishman and Van Kirk

[57] ABSTRACT

A brush guide for guiding a brush to provide for the painting of a continuous line, the brush guide comprising an elongated body including a continuous edge and at least two support legs extending from the body, each leg defining a flat base portion, the legs defining an elongated space therebetween, the base portion of the legs being offset from a vertical projection of the edge to accommodate the brush during painting.

7 Claims, 2 Drawing Figures

BRUSH GUIDE

BACKGROUND OF THE INVENTION (1) Field of the Invention

The present invention relates to painting. More particularly, the present invention relates to an apparatus for guiding a brush to provide for the painting of a continuous line.

(2) Description of the Prior Art

When painting pictures, industrial designs, advertising posters, artists have long desired to paint a smooth, continuous line. One prior art method of painting the line is to manually hold a ruler at an angle with one hand and hold a paint brush in the vertical position and move the brush along the length of the straight edge with the other hand. Since the straight edge is held manually, the straight edge may move during the course of painting the line, and, the painted line may be discontinuous or uneven.

It is an object of the present invention to provide a brush guide for painting continuous lines.

SUMMARY OF THE INVENTION

The present invention provides a brush guide for guiding a brush to paint a continuous line. The brush guide comprises an elongated body including a continuous edge which functions as the guide for the brush. The brush guide further includes at least two support legs which extend from and are integral with the body to define a flat base portion. The flat base portion of the legs rest on the paper to be painted. Because the base portions of the legs are flat, the brush guide may be held in place with relative ease. The legs are spaced apart to define an elongated space therebetween.

A typical paint brush includes a relatively long handle and a brush portion containing bristles. In using the brush guide of the present invention, the handle portion of the brush is held in a vertical position and drawn manually along the edge. As the brush portion of the paint brush contacts the paper, bristles of the brush portion spread. The spreading of the bristles is accommodated by the brush guide because the base portion of the legs is offset from a vertical projection of said edge. This offset is provided for by the body which includes a wall which extends between the base portions of the legs and the linear edge, the wall being at an angle greater than 90° with respect to the flat portion of the legs. The legs of the brush guide are spaced apart to define an elongated space therebetween. This space may also accommodate the spreading of the brush.

It should be appreciated that the brush guide of the present invention is particularly simple to use, provides for the painting of a continuous line and is relatively simple to fabricate. Other advantages of the brush guide of the present invention will be apparent from the following detailed description of the invention.

DETAILED DESCRIPTION OF THE INVENTION

Figure 1:
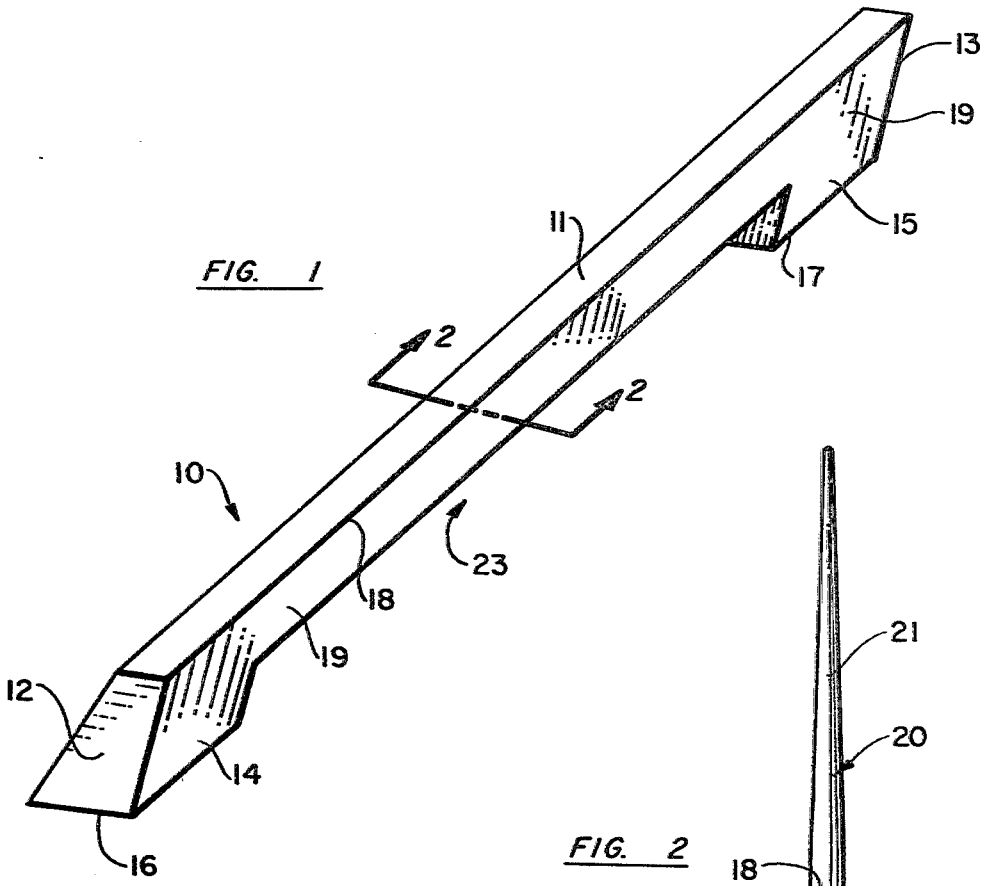
FIG. 1 is a perspective view of the brush guide.
Figure 2:
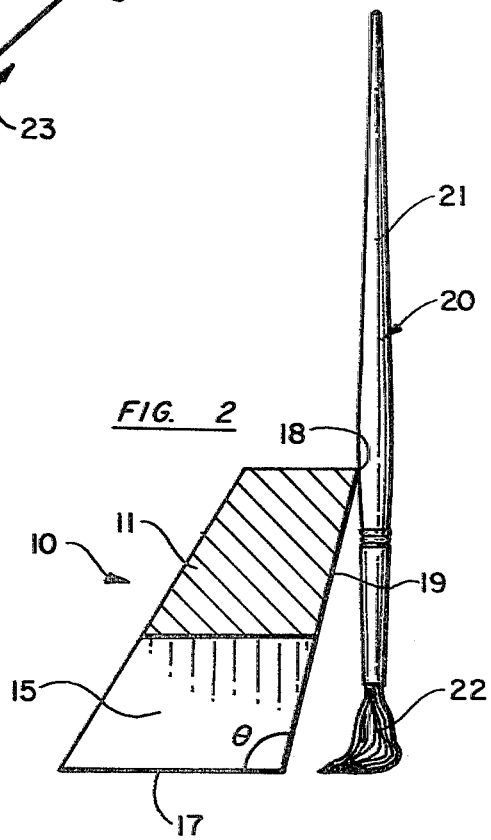
FIG. 2 is a sectional view of the brush guide along the line 2—2 in FIG. 1, a brush being shown in FIG. 2 to exemplify the manner by which the brush is guided to paint a continuous line.

Referring to FIGS. 1 and 2, the brush guide 10 comprises an elongated body portion 11 which terminates at ends 12 and 13. Brush guide 10 further includes two support legs 14 and 15 which are spaced apart to define an elongated space 23 therebetween. This space may accommodate the spreading of the bristles of a brush used with the brush guide 10. The legs terminate in flat base portions 16 and 17, the flat base portions resting on the material to be painted. Because these base portions are flat, the brush guide may be maintained in position with relative ease. Body portion 11 defines a continuous linear edge 18 which guides the brush during painting. Preferably legs 14 and 15 are integral with body 11 and the body and the legs define a relatively flat wall which extends between the base portions 16 and 17 and edge 18. The angle between the base portions 16 and 17 and wall 19 is greater than 90° to provide space for the spreading of the bristles of a brush used with brush guide 10. Restated, the base portions of the legs are offset from a vertical projection of the edge so as to accommodate the bristles of the brush.

As shown in FIG. 2, a typical paint brush 20 includes a handle portion 21 and a brush portion 22. In using the brush guide of the present invention, the handle 21 of brush 20 is held in a vertical position and contacts edge 18. The brush handle 21 is drawn manually along the length of the edge 18. The brush portion 22 paints a continuous linear line. As the line is painted, the bristles of brush 22 may spread and flatten out. In order to accommodate the spreading of the brush portion 22, the base portions of said legs are offset from a vertical projection of edge 18. Also, the space 15 between the legs may also accommodate the spreading of the brush portion 22.

The brush guide of the present invention is particularly simple in that it may comprise a single piece of wood or other material which is cut to the shape shown in FIG. 1. The brush guide is particularly simple to use in that the brush guide may be held in position by engaging the upper surface of body portion 11 by one hand and moving the brush with the other hand. Once the brush guide is in position, the edge 18 remains stable to allow the painter to paint a continuous and neat line.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A device for guiding a brush to provide for the painting of a continuous line comprising:

an elongated body, said body having a trapezoidal cross-sectional shape with parallel top and bottom surfaces and a pair of flat side surfaces interconnecting said top and bottom surfaces, said body top surface having a smaller area than said body bottom surface, a first continuous linear edge of said top surface defining a brush guide, a first of said body side surfaces extending from said first edge to a first edge of said body bottom surface, said first side and bottom surfaces meeting at an angle of greater than 90° whereby said top surface first edge is vertically offset from said bottom surface first edge; and a pair of spaced apart legs extending from said body bottom surface, said legs defining an elongated space therebetween, said legs having the same cross-sectional shape as said body and having side surfaces which define extensions of said body side surfaces, said device being supported on flat bottom surfaces of said legs and first edges of bottom surfaces of said legs being vertically offset from said body top surface first edge by a greater distance than said body bottom surface first edge.

2. The device of claim 1 wherein said body top surface defines an uninterrupted plane.

3. The device of claim 1 wherein the second edges of said parallel body top and bottom surfaces are parallel with said first edges and wherein the angle between said bottom surface second edge and the adjoining side surface is less than 90°.

4. The device of claim 2 wherein the second edges of said parallel body top and bottom surfaces are parallel with said first edges and wherein the angle between said bottom surface second edge and the adjoining side surface is less than 90°.

5. The device of claim 1 wherein said legs are integral with said body.

6. The device of claim 2 wherein said legs are integral with said body.

7. The device of claim 4 wherein said legs are integral with said body.

* * * * *